US007216815B2

(12) United States Patent
Magel

(10) Patent No.: US 7,216,815 B2
(45) Date of Patent: May 15, 2007

(54) CONTROL VALVE FOR A FUEL INJECTOR COMPRISING A PRESSURE EXCHANGER

(75) Inventor: Hans-Christoph Magel, Pfullingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/566,247

(22) PCT Filed: Jun. 17, 2004

(86) PCT No.: PCT/DE2004/001255

§ 371 (c)(1),
(2), (4) Date: Jan. 30, 2006

(87) PCT Pub. No.: WO2005/015002

PCT Pub. Date: Feb. 17, 2005

(65) Prior Publication Data

US 2006/0202140 A1 Sep. 14, 2006

(30) Foreign Application Priority Data

Jul. 31, 2003 (DE) ..... 103 35 059

(51) Int. Cl.
*F02M 47/02* (2006.01)
*B05B 1/30* (2006.01)

(52) U.S. Cl. ..... 239/88; 239/89; 239/91; 239/124; 239/533.1; 123/467; 123/446; 123/496

(58) Field of Classification Search ..... 239/88, 239/89, 91, 124, 533.2, 533.3, 533.9, 533.11; 123/467, 447, 446, 496, 500; 251/30.01
See application file for complete search history.

(56) References Cited

U.S. PATENT DOCUMENTS

| | | | | |
|---|---|---|---|---|
| 4,219,154 | A | 8/1980 | Luscomb | |
| 6,085,719 | A * | 7/2000 | Heinz et al. | 123/300 |
| 6,364,282 | B1 * | 4/2002 | Ausman et al. | 251/129.16 |
| 6,453,875 | B1 | 9/2002 | Mahr et al. | |
| 6,880,527 | B2 * | 4/2005 | Magel | 123/467 |
| 2004/0025843 | A1 | 2/2004 | Magel | |

FOREIGN PATENT DOCUMENTS

DE 102 18 904 A1 12/2002

* cited by examiner

*Primary Examiner*—Dinh Q. Nguyen
(74) *Attorney, Agent, or Firm*—Ronald E. Greigg

(57) ABSTRACT

A servo-valve for a fuel injector equipped with a pressure booster whose working chamber is separated from a differential pressure chamber by a booster piston in which an actuator can connect a control chamber to a first low-pressure return and the differential pressure chamber can be connected to a second low-pressure return or to a return system in which the returns are connected to each other. A first servo-valve piston has a first sealing seat, and a second piston, embodied as a sealing sleeve, is accommodated on the first servo-valve piston and, together with a valve housing, constitutes a second sealing seat. When the pressure in the control chamber is relieved, this second sealing seat is closed with a shorter stroke, sooner than the first sealing seat. When the control chamber is subjected to pressure, the second sealing seat opens only after the first sealing seat is closed.

18 Claims, 2 Drawing Sheets

CONTROL VALVE FOR A FUEL INJECTOR COMPRISING A PRESSURE EXCHANGER

CROSS-REFERENCE TO RELATED APPLICATIONS

This application is a 35 USC 371 application of PCT/DE 2004/001255 filed on Jun. 17, 2004.

BACKGROUND OF THE INVENTION

1. Field of the Invention

This invention relates to an improved servo-valve, and more particularly to such a valve useful in a fuel injector equipped with a pressure booster.

2. Description of the Prior Art

Known stroke-controlled high-pressure accumulator injection systems (common rail) can be used to inject fuel in direct-injecting internal combustion engines. These injection systems are distinguished by the fact that the injection pressure can be adapted to the load and speed of the engine. A high injection pressure is required in order to reduce emissions and to achieve high specific outputs. Since the achievable pressure level in high-pressure fuel pumps is limited for strength reasons, a further pressure increase in high-pressure injection systems (common rail) can be achieved by means of pressure boosters in injectors.

DE 101 23 913 has disclosed a fuel injection apparatus for internal combustion engines, having a fuel injector that can be supplied from a high-pressure fuel source. A pressure boosting device that has a movable pressure booster piston is connected between the fuel injector and the high-pressure fuel source. The pressure booster piston divides a chamber that can be connected to the high-pressure fuel source from a high-pressure chamber connected to the fuel injector. The fuel pressure in the high-pressure chamber can be varied by filling a return chamber of the pressure boosting device with fuel or by emptying fuel from the return chamber. The fuel injector has a movable closing piston for opening and closing injection openings; the closing piston protrudes into a closing pressure chamber. Fuel pressure can be exerted on the closing piston to produce a force that acts on the closing piston in the closing direction. The closing pressure chamber and the return chamber are constituted by a combined closing pressure/return chamber; all of the partial regions of the closing pressure/return chamber are permanently connected to one another to permit the exchange of fuel. A pressure chamber is provided for supplying fuel to the injection openings and for exerting a force on the closing piston in the opening direction. The high-pressure chamber is connected to the high-pressure fuel source so that aside from pressure fluctuations, at least the fuel pressure of the high-pressure fuel source can continuously prevail in the high-pressure chamber. The pressure chamber and the high-pressure chamber are constituted by a combined injection chamber whose partial regions are permanently connected to one another to permit the exchange of fuel.

In fuel injectors, servo-valves can be used as on/off valves, which have a one-piece servo-valve piston whose control cross sections are embodied in a seat/slider design. In servo-valves of this kind, a significant amount of wear on the slider surfaces can occur since only short overlap lengths can be achieved. In addition, in servo-valves with a seat/slider design, high demands are placed on manufacturing precision, particularly with regard to the position of the control edges of the servo-valve piston in relation to each other.

SUMMARY OF THE INVENTION

The design proposed according to the present invention of an on/off valve, which is embodied as a servo-valve, in the form of a 3/2-way double seat valve for controlling a fuel injector, includes a valve piston to which a first valve piston is attached, which has a first sealing seat. The first valve piston is adjoined by an additional, second valve piston that performs the function of a sealing sleeve. The second valve piston has a second sealing seat embodied on it; the second valve piston is embodied so that it is pressed against a valve housing by a spring, which rests against the first valve piston, and, together with the valve housing against which it rests, constitutes the second sealing seat. Because of this embodiment of the valve piston of the 3/2-way double seat valve proposed according to the present invention, the second sealing seat closes after a significantly shorter partial stroke of the valve. Independent of the closing of the second sealing seat, however, the first sealing seat continues to open until a much greater stroke is reached. The design proposed according to the present invention, in which an on/off valve that controls a fuel injector is embodied in the form of a 3/2-way double seat valve, permits an optimal injector tuning without large leakage quantities. The two-part servo-valve embodied according to the present invention can advantageously be used in fuel injectors equipped with a pressure booster, regardless of whether this is integrated into the fuel injector or mounted onto it, which injectors are triggered by means of a relief or exertion of pressure in the differential pressure chamber (return chamber) of the pressure booster.

The design proposed according to the present invention avoids the disadvantages that occur with excessively short overlap lengths of slider sealing seats that frequently result in high leakage quantities and poor injector dynamics.

BRIEF DESCRIPTION OF THE DRAWINGS

The present invention will be described in greater detail below, in conjunction with the drawings, in which.

DESCRIPTION OF THE PREFERRED EMBODIMENTS

Figure 1:
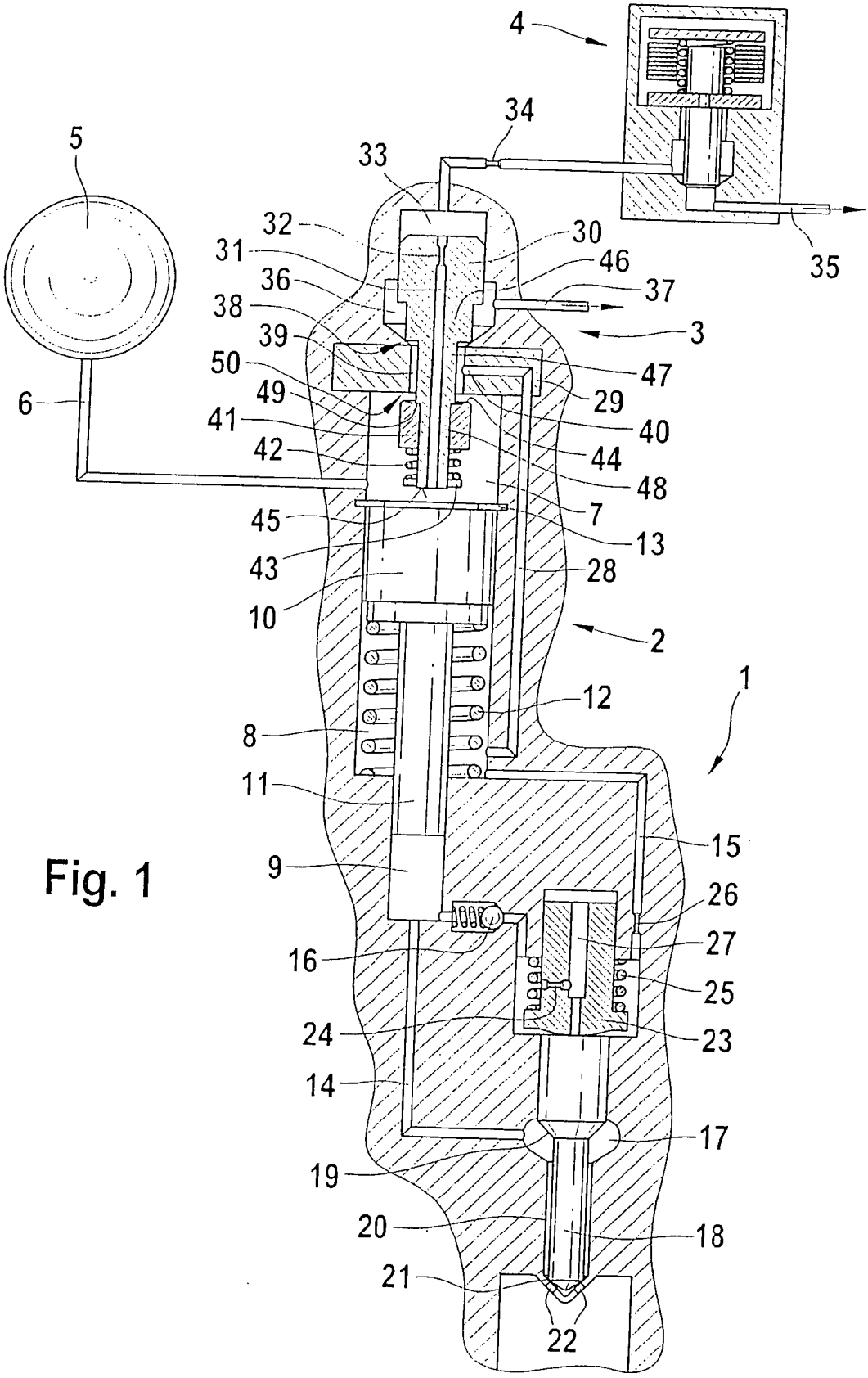
FIG. 1 shows an exemplary embodiment of a valve that is embodied in the form of a 3/2-way double seat valve for a fuel injector equipped with a pressure booster, in the deactivated state.

The depiction in FIG. 1 shows an exemplary embodiment of a 3/2-way double seat valve for a fuel injector. The fuel injector 1 includes a pressure booster 2 and an on/off valve, which is embodied in the form of a servo-valve 3. The servo-valve 3 can be actuated by means of an actuator 4 which can be embodied in the form of either a solenoid valve or a piezoelectric actuator, possibly with the interposition of a hydraulic coupling chamber.

The fuel injector 1 is supplied with highly pressurized fuel by means of a pressure accumulator 5 (common rail). Via a high-pressure line 6, the system pressure inside the pressure accumulator 5 prevails in the working chamber 7 of the pressure booster 2. The pressure booster 2 also includes a differential pressure chamber 8 (return chamber), which is separated from the working chamber 7 by a two-part booster piston includes a first booster piston part 10 and a second booster piston part 11. A spring element 12 resting against the bottom of the differential pressure chamber 8 acts on the second booster piston part 11 and moves the booster pistons 10, 11 back in the direction of their idle position against a stop ring 13 seated in the working chamber 7.

The second booster piston part 11 acts on a compression chamber 9 of the pressure booster 2 with a pressure that is increased in accordance with the boosting ratio of the pressure booster 2. A nozzle chamber inlet 14 extends from the compression chamber 9 to a nozzle chamber 17 of the fuel injector 1. When the pressure booster 2 is deactivated, the compression chamber 9 is refilled via a filling valve 16, which is embodied in the form of a check valve in the depiction in FIG. 1. The booster piston, which is comprised of two parts in the depiction in FIG. 1 (see reference numerals 10, 11), can also be embodied in one piece.

The nozzle chamber 17 encompasses an injection valve member 18, which is embodied in the form of a nozzle needle and has a pressure shoulder 19. From the nozzle chamber 17, an annular gap 20 extends to a seat 21 of the injection valve member 18. Underneath the seat 21, injection openings 22 are provided, through which fuel is injected into the combustion chamber of an internal combustion engine when the injection valve member 18 is lifted away from the seat 21. The end surface of the injection valve member 18 is acted on by a closing piston 23 whose spherically embodied end surface contacts the end surface of the needle-shaped injection valve member 18. The closing piston 23 contains an overflow throttle 34 via which a through bore 27 of the closing piston 23 communicates with a chamber containing a spring element 25. The spring element 25 acts on the closing piston 23 in the closing direction. A control chamber line 15 containing a first throttle restriction 26 extends from the hydraulic chamber containing the spring element 25 to the differential pressure chamber 8 (return chamber) of the pressure booster 2.

The pressure in the differential pressure chamber 8 of the pressure booster 2 is relieved via a discharge line 28, which feeds into a valve housing 29 of the servo-valve 3 at a junction point 40. The valve housing 29 of the servo-valve 3 includes a servo-valve piston 30 containing a through conduit 31 that includes a second throttle restriction 32 located at the point at which the through conduit 31 opens out into a control chamber 33 of the servo-valve 3. A line that contains an outlet throttle 34 branches off from the control chamber 33 and leads into the first low-pressure return 35. The pressure in the control chamber 33 of the servo-valve 3 can be relieved by actuating the actuator 4, which can be embodied in the form of either a solenoid valve or a piezoelectric actuator.

The servo-valve piston 30 is encompassed by a servo-valve chamber 36 that has a second low-pressure return 37 branching off from it to permit control volumes to be discharged. The two returns 35, 37 can also be joined together inside the injector and connected to a combined return system.

The servo-valve housing 29 is provided with a first sealing seat 38 that cooperates with an annular surface of a first shaft region 46 of the servo-valve piston 30. The first shaft region 46 of the servo-valve piston 30 is adjoined by a second reduced-diameter second shaft region 47, which is encompassed by an annular chamber 39 inside the servo-valve housing 29. The second shaft region 47 of the servo-valve piston has a stop surface 49 for a second servo-valve piston 41 accommodated in moving fashion on the first servo valve piston 30. The second servo-valve piston 41 is supported so that it can move within the range of a third shaft region 48 on the first servo-valve piston 30 and is acted on by a spring element 42 that rests against a spring element support 43 at the bottom end of the third shaft region 48. Oriented toward the working chamber, the third shaft region 48 of the first servo-valve piston 30 has an end surface 45 that is subjected to the pressure prevailing in the working chamber 7 of the pressure booster 2. The second movably supported servo-valve piston 41 has a contoured piston surface 44, which, together with the valve housing 29, constitutes an additional, second sealing seat 50.

In the deactivated idle position of the pressure booster 2 shown in FIG. 1, the open second sealing seat 50 below the servo-valve housing 29 allows the system pressure present in the working chamber 7 of the pressure booster 2 to travel via the junction point 40 and the discharge line 28 so that it also prevails in the differential pressure chamber 8 (return chamber) of the pressure booster 2. As a result, the pressure booster is balanced due to the identical pressures prevailing in the working chamber 7 and in the differential pressure chamber 8 (return chamber) and no pressure boosting takes place. The movement of the first shaft region 46 of the first servo-valve piston 30 into the first sealing seat 38 closes the second low-pressure return 37; the movement of the actuator 4 into its closed position also closes the first low-pressure return 35.

In the idle position of the pressure booster 2 shown in FIG. 1, no injection is taking place since the pressure prevailing in the differential pressure chamber 8 moves the closing piston 23 and the injection valve element 28—assisted by the spring element 25—into the closed position and no increased force of pressure acts in the opening direction on the pressure shoulder 19 of the injection valve member 18.

Figure 2:
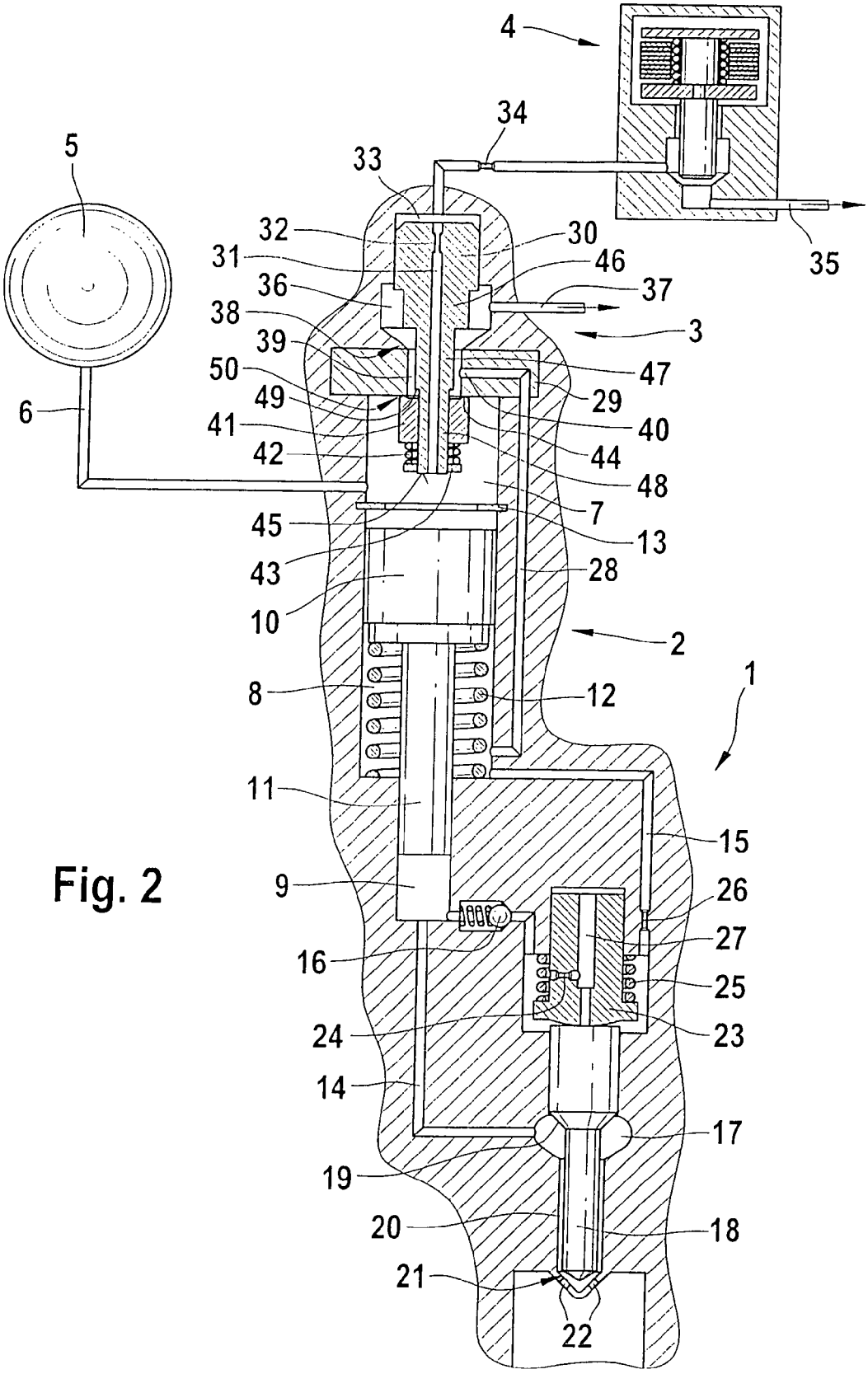
FIG. 2 shows the 3/2-way double seat valve shown in FIG. 1, in the activated state.

FIG. 2 shows the activation of the pressure booster of the fuel injector when the actuator is triggered.

To trigger the pressure booster 2, the pressure in the differential pressure chamber 8 of the pressure booster 2 is relieved via the discharge line 28. To that end, the actuator 4, which is embodied in the form of either a solenoid valve or a piezoelectric actuator, is triggered so that the first low-pressure return 35 is opened. Then fuel flows out of the control chamber 33 of the servo-valve 3 into the first low-pressure return 35 as a result of which the end surface of the first servo-valve piston 30 travels into the control chamber 33 of the servo-valve 3. When the first servo-valve piston 30 moves upward, the second sealing seat 50 is closed before the first sealing seat 38 is finished opening. As a result, a fuel volume flows out of the differential pressure chamber 8, via the discharge line 28, the junction point 40, and the annular chamber 39 into the second low-pressure return 37 so that the booster piston 10, 11 then travels into the compression chamber 9. As a result, fuel travels into the nozzle chamber 17 at a pressure that is increased in accordance with the boosting ratio of the pressure booster 2. This causes an increased hydraulic force acting on the pressure shoulder 9 in the opening direction to be exerted on the injection valve member 18, which opens, thus unblocking the injection openings 22 that are located under the seat 21 of the injection valve member 18 and lead into the combustion chamber of the engine.

When the pressure in the control chamber 33 of the servo-valve 3 is relieved, even a slight upward stroke causes the second sealing seat 50 between the servo-valve housing 29 and the contoured surface 44 of the second servo-valve piston 41 to close. The force of pressure prevailing in the working chamber 7 of the pressure booster 2 and acting on the working chamber end surface 45 of the servo-valve piston 30 causes the first servo-valve piston 30 to continue moving after the second sealing seat 50 is closed so that the first sealing seat 38 opens further.

With the design according to present invention of the first servo-valve piston 30, which is provided with a first sealing seat 38 and a moving second servo-valve piston 41 functioning as a sealing sleeve, the second sealing seat 50 can be completely closed even after a small valve stroke; independent of this, the first sealing seat 38 opens in accordance with a continuing stroke motion of the first servo-valve piston 30. This makes a significant contribution to improving the injector dynamics of the fuel injector 1. Furthermore, the design of the servo-valve 3 according to the present invention can significantly reduce the leakage quantities that occur when triggering the pressure booster 2.

To terminate the injection, the actuator 4 is triggered so that the first low-pressure return 35 is closed again. This causes the pressure to increase again in the control chamber 33 of the servo-valve 3 as a result of the fuel flowing into it from the working chamber 7 via the through conduit 31. The first servo-valve piston 30 travels into the first sealing seat 38 and closes it. During the inward to travel of the first servo-valve piston 30 into the first sealing seat 38, the stop 49 provided at the piston end of the second shaft region 47 of the first servo-valve piston 30 strikes against the second servo-valve piston 41, thus opening the second sealing seat 50. As a result, fuel at system pressure can flow from the working chamber 7, via the junction point 40 and the discharge line 28, into the differential pressure chamber 8 of the pressure booster 2. As a result, the two-part booster piston 10, 11 travels out of the compression chamber 9, into which replenishing fuel now flows via the filling valve 16 from the chamber containing the spring element 25.

Either a stop 49 or a spring element 42 can be provided to assure a definite starting position of the second servo-valve piston 41 accommodated in moving fashion on the first servo-valve piston 30. Spring elements that are not shown in the embodiment variant according to FIGS. 1 and 2 can be provided to assist the stroke motion of the first servo-valve piston 30. Both the first sealing seat 38 and the second sealing seat 50 can be embodied in a multitude of ways. In the exemplary embodiment shown in FIGS. 1 and 2, the second servo-valve piston 41 is embodied, for example, with a contoured end surface 44 that cooperates with a flat seat on the servo-valve housing 29. In addition to providing a flat seat on the servo-valve housing 29 in relation to the second sealing seat 50 or embodying the first sealing seat 38 in the form of a conical seat, as depicted in FIGS. 1 and 2, other seat geometries can also be used in the first sealing seat 38 and second sealing seat 50 in the servo-valve 3.

The embodiment proposed according to the present invention of a servo-valve piston in the form of a two-part piston 30, 41 makes it possible to close the second sealing seat 50 after a short valve stroke of the first servo-valve piston 30, whereas the first sealing seat 38 opens further, independent of the closing of the second sealing seat 50. To reduce leakage quantities when triggering the pressure booster 2, the servo-valve design proposed according to the present invention makes it possible for the second sealing seat 50 to be opened by means of the stop 49 oriented toward the piston only after the first sealing seat 38 leading to the second low-pressure return 37 is already partway closed. Only then is the second sealing seat 50 opened so that the system pressure prevailing in the working chamber 7, traveling via the discharge line 28, also prevails in the differential pressure chamber 8 of the pressure booster 2 and only a small amount of it escapes into the second low-pressure return 37, which is already almost completely closed at the first sealing seat 38 by the first shaft region 46 of the first servo-valve piston 30.

The foregoing relates to preferred exemplary embodiments of the invention, it being understood that other variants and embodiments thereof are possible within the spirit and scope of the invention, the latter being defined by the appended claims.

The invention claimed is:

1. In a servo-valve for a fuel injector equipped with a pressure booster whose working chamber is separated from a differential pressure chamber by a booster piston; an actuator can connect a control chamber of the servo-valve to a low-pressure return; and the differential pressure chamber of the pressure booster can be connected to a low-pressure return or to a return system in which the returns are connected to each other, the improvement comprising a first servo-valve piston having a surface continuously acted on by system pressure, with a first sealing seat on the first servo-valve piston, and a second servo-valve piston embodied in the form of a sealing sleeve and accommodated in an axially sliding fashion on the first servo-valve piston, the second servo-valve piston together with a valve housing, constituting a second sealing seat so that after the second sealing seat is closed by the second servo-valve piston, the first servo-valve piston opens the first sealing seat further.

2. The servo-valve according to claim 1, wherein the first sealing seat is embodied on a first shaft region of the first servo-valve piston.

3. The servo-valve according to claim 1, wherein the first servo-valve piston comprises a second shaft region whose piston end is provided with a stop oriented toward the second servo-valve piston.

4. The servo-valve according to claim 2, wherein the first servo-valve piston comprises a second shaft region whose piston end is provided with a stop oriented toward the second servo-valve piston.

5. The servo-valve according to claim 1, wherein the first servo-valve piston comprises a third shaft region on which the second servo-valve piston, which is embodied in the form of a sealing sleeve, is accommodated in a spring-loaded fashion.

6. The servo-valve according to claim 2, wherein the first servo-valve piston comprises a third shaft region on which the second servo-valve piston, which is embodied in the form of a sealing sleeve, is accommodated in a spring-loaded fashion.

7. The servo-valve according to claim 3, wherein the first servo-valve piston comprises a third shaft region on which the second servo-valve piston, which is embodied in the form of a sealing sleeve, is accommodated in a spring-loaded fashion.

8. The servo-valve according to claim 5, wherein the third shaft region of the first servo-valve piston protrudes into the working chamber of the pressure booster.

9. The servo-valve according to claim 6, wherein the third shaft region of the first servo-valve piston protrudes into the working chamber of the pressure booster.

10. The servo-valve according to claim 7, wherein the third shaft region of the first servo-valve piston protrudes into the working chamber of the pressure booster.

11. The servo-valve according to claim 5, wherein the third shaft region of the first servo-valve piston has an end surface, which is oriented toward the working chamber and is acted on by the system pressure in the working chamber.

12. The servo-valve according to claim 6, wherein the third shaft region of the first servo-valve piston has an end surface, which is oriented toward the working chamber and is acted on by the system pressure in the working chamber.

13. The servo-valve according to claim 7, wherein the third shaft region of the first servo-valve piston has an end surface, which is oriented toward the working chamber and is acted on by the system pressure in the working chamber.

14. The servo-valve according to claim 1, wherein the first servo-valve piston comprises a through conduit having an end oriented toward the control chamber provided with a second throttle restriction.

15. The servo-valve according to claim 1, further comprising a line that exerts pressure on the differential pressure chamber of the pressure booster, and a line that relieves the pressure in the differential pressure chamber feeds into a servo-valve housing of the servo-valve at a junction point that lies between the first sealing seat and the second sealing seat.

16. The servo-valve according to claim 1, wherein the second sealing seat is embodied in the form of a flat seat between the servo-valve housing and the second closing piston.

17. The servo-valve according to claim 16, wherein the second sealing seat, which is embodied in the form of a flat seat, is provided between the servo-valve housing and a contoured piston surface of the second servo-valve piston.

18. The servo-valve according to claim 1, wherein the second sealing seat is embodied in the form of a conical seat between the servo-valve housing and the second closing piston.

* * * * *